US008574338B2

(12) United States Patent
Irizarry et al.

(10) Patent No.: US 8,574,338 B2
(45) Date of Patent: Nov. 5, 2013

(54) REACTOR AND CONTINUOUS PROCESS FOR PRODUCING SILVER POWDERS

(75) Inventors: Roberto Irizarry, Raleigh, NC (US); Kalyana C. Pyada, Cary, NC (US)

(73) Assignee: E I du Pont de Nemours and Company, Wilmington, DE (US)

( * ) Notice: Subject to any disclaimer, the term of this patent is extended or adjusted under 35 U.S.C. 154(b) by 512 days.

(21) Appl. No.: 12/948,098

(22) Filed: Nov. 17, 2010

(65) Prior Publication Data

US 2012/0118105 A1 May 17, 2012

(51) Int. Cl.
*B22F 9/24* (2006.01)

(52) U.S. Cl.
USPC ..... 75/371

(58) Field of Classification Search
USPC ..... 75/343, 362, 370, 371, 387, 710, 711, 75/721–723, 739–741; 266/78, 81–89, 266/200–248, 265–270; 422/129, 139–147, 422/149, 600–659, 198–208, 225–233, 422/236–238, 244, 307, 308, 311
See application file for complete search history.

(56) References Cited

U.S. PATENT DOCUMENTS

| | | | | |
|---|---|---|---|---|
| 2,900,245 | A * | 8/1959 | Beller | 75/362 |
| 5,389,122 | A | 2/1995 | Glicksman | |
| 5,921,678 | A * | 7/1999 | Desai et al. | 366/336 |
| 6,624,886 | B2 * | 9/2003 | Natan et al. | 356/301 |
| 6,929,783 | B2 * | 8/2005 | Chung et al. | 422/187 |
| 7,648,557 | B2 | 1/2010 | Irizarry-Rivera | |
| 2004/0039069 | A1 * | 2/2004 | Kiuchi et al. | 518/726 |
| 2005/0257643 | A1 | 11/2005 | Ogi et al. | |
| 2005/0279970 | A1 | 12/2005 | Ogi et al. | |
| 2006/0115387 | A1 * | 6/2006 | Louret et al. | 422/139 |
| 2007/0079665 | A1 * | 4/2007 | Sasaki et al. | 75/255 |
| 2007/0286778 | A1 * | 12/2007 | Mercuri | 422/129 |
| 2008/0028889 | A1 * | 2/2008 | Irizarry-Rivera et al. | 75/371 |
| 2008/0138238 | A1 | 6/2008 | Sasaki et al. | |
| 2008/0254567 | A1 | 10/2008 | Konno | |
| 2010/0101637 | A1 | 4/2010 | Yamasaki et al. | |

FOREIGN PATENT DOCUMENTS

| | | | | | |
|---|---|---|---|---|---|
| CN | 101579746 | A | | 11/2009 | |
| JP | 63-307206 | A | | 12/1988 | |
| JP | 04-333504 | A | * | 11/1992 | B22F 9/24 |
| JP | 2000-239713 | A | * | 9/2000 | B22F 9/24 |
| JP | 2006-111903 | A | * | 4/2006 | B22F 9/24 |
| JP | 2006-6225760 | A | | 8/2006 | |
| JP | 2007-270312 | A | | 10/2007 | |
| JP | 2007-270312 | A | * | 10/2007 | B22F 9/24 |
| JP | 2010-070793 | A | | 4/2010 | |
| WO | 2007/143125 | A2 | | 12/2007 | |

OTHER PUBLICATIONS

English abstract by PAJ (Patent Abstracts of Japan) of JP 04-333504, application published originally on Nov. 20, 1992.*

(Continued)

*Primary Examiner* — Scott Kastler
*Assistant Examiner* — Vanessa Luk

(57) ABSTRACT

Disclosed herein is a continuous process for producing silver powders comprising silver particles. Each powder is comprised of silver particles that have a specific morphology that is determined by the process conditions and the use of one or more particle modifiers in the process. A reactor for carrying out the process is also disclosed. The silver powders produced are particularly useful in electronic applications.

16 Claims, 6 Drawing Sheets

(56) References Cited

OTHER PUBLICATIONS

English abstract and Computer-Generated Translation of JP 2000-239713, originally published on Sep. 5, 2000.*
English abstract and Computer-Generated Translation of JP 2006-111903, originally published on Apr. 27, 2006.*
English abstract and Computer-Generated Translation of JP 2007-270312, originally published on Oct. 18, 2007.*
Professional translation of JP 04-333504 (Noboru Kunimine et al.), originally published on Nov. 20, 1992 in the Japanese language.*
Dai et al., Preparation and Characterization of Fine Silver Powder With Colloidal Emulsion Aphrons, Journal of Membrane Science, Sep. 15, 2006, pp. 685-691, vol. 281, No. 1-2.
Widoniak et al., Silver Particles Tailoring of Shapes and Sizes, Colloids and Surfaces A: Physicachemical and Engineering Aspects, Dec. 1, 2005, pp. 340-344, vol. 270-271.
Nagaoka et al., Investigation and Application of Silver Powder Reduced With L-Ascorbic Acid (or LAX AG), International Precious Metals Conference, Jun. 14, 2003, pp. 9-21.
Lim et al., A Statistical Design and Analysis Illustrating the Interactions Between Key Experimental Factors for the Synthesis of Silver Nanoparticles, Colloids and Surfaces A: Physicachemical and Engineering Aspects, Jun. 5, 2008, pp. 155-163, vol. 322, No. 1-3.
Sondi et al., Preparation of Highly Concentrated Stable Dispersions of Uniform Silver Nanoparticles, Journal of Colloid and Interface Science, Apr. 1, 2003, pp. 75-81, vol. 260, No. 1.
Velikov et al., Synthesis and Characterization of Large Colloidal Silver Particles, Langmuir, Feb. 18, 2003, pp. 1384-1389, vol. 19, No. 4.
Halaciuga et al., Preparation of Silver Spheres by Aggregation of Nanosize Subunits, Journal of Materials Research, Jun. 6, 2008, pp. 1776-1784, vol. 23, No. 6.
Suber et al., Preparation and the Mechanisms of Formation of Silver Particles of Different Morphologies in Homogeneous Solutions, Journal of Colloid and Interface Science, 2005, pp. 489-495, vol. 288.
U.S. Appl. No. 12/770,846, filed Apr. 30, 2010.
U.S. Appl. No. 12/770,902, filed Apr. 30, 2010.
U.S. Appl. No. 12/770,842, filed Apr. 30, 2010.
U.S. Appl. No. 12/871,167, filed Aug. 30, 2010.

* cited by examiner

REACTOR AND CONTINUOUS PROCESS FOR PRODUCING SILVER POWDERS

FIELD OF THE INVENTION

The invention is directed to a continuous process for producing silver powders comprising silver particles with particular morphologies and a reactor for carrying out such a process. The silver powders produced are particularly useful in electronic applications.

TECHNICAL BACKGROUND OF THE INVENTION

Silver powder is used in the electronics industry for the manufacture of conductor thick film pastes. The thick film pastes are screen printed onto substrates forming conductive circuit patterns. These circuits are then dried and fired to volatilize the liquid organic vehicle and sinter the silver particles.

Printed circuit technology is requiring denser and more precise electronic circuits. To meet these requirements, the conductive lines have become narrower in width with smaller distances between lines. The silver powder particles necessary to form dense, closely packed, narrow lines must be as close as possible to monosized, dense packing spheres.

Many processes currently used to manufacture metal powders can be applied to the production of silver powders. For example, thermal decomposition processes, electrochemical processes, physical processes such as atomization or milling and chemical reduction processes can be used. Thermal decomposition processes tend to produce powders that are spongy, agglomerated, and very porous whereas electrochemical processes produce powders that are crystalline in shape and very large. Physical processes are generally used to make flaked materials or very large spherical particles. Chemical precipitation processes produce silver powders with a range of sizes and shapes.

Silver powders used in electronic applications are generally manufactured using chemical precipitation processes. Silver powder is produced by chemical reduction in which an aqueous solution of a soluble salt of silver is reacted with an appropriate reducing agent under conditions such that silver powder can be precipitated.

There is a need for a continuous process to efficiently produce silver particles and for a reactor in which to carry out the process.

SUMMARY OF THE INVENTION

This invention provides a continuous process for preparing a silver powder comprising silver particles, wherein the silver particles have a specific morphology that is determined by the process conditions and the use of one or more particle modifiers in the process.

In one embodiment, the continuous process for preparing a silver powder comprises the steps of:

(a) preparing an acidic aqueous silver salt solution comprising a water soluble silver salt dissolved in deionized water;

(b) preparing an acidic reducing solution comprising:
  i. a reducing agent selected from the group consisting of an ascorbic acid, an ascorbate and mixtures thereof dissolved in deionized water;
  ii. nitric acid; and
  iii. one or more particle modifiers;

(c) maintaining the acidic aqueous silver salt solution and the acidic reducing solution at the same temperature $T_M$, wherein $T_M$ is in the range of 10° C. to 90° C.;

(d) providing a flow reactor comprising
  i. a mixing chamber with a diameter d and means to control temperature and containing two inlets; and
  ii. a reaction chamber with a diameter D and means to control temperature, wherein D>d, wherein the flow reactor has an axis along the length of the reactor, the axis is vertical and the flow direction is along the axis;

(e) continuously feeding the acidic aqueous silver salt solution into one inlet of the mixing chamber and continuously feeding the acidic reducing solution into the other inlet of the mixing chamber to form a reaction mixture in the mixture chamber and maintaining the reaction mixture in the mixing chamber at the temperature $T_M$ of (c), wherein the residence time of the reaction mixture in the mixing chamber is up to and including 5 minutes and upon completion of the residence time the reaction mixture exits the mixing chamber and enters the reaction chamber;

(f) maintaining the reaction mixture in the reaction chamber at the temperature $T_R$, wherein $T_R$ is in the range of 10° C. to 90° C. and wherein the residence time of the reaction mixture in the reaction chamber is from 1 to 20 minutes and results in the production of the silver powder particles in a final aqueous solution; and (g) collecting the silver powder particles in the final aqueous solution as the final aqueous solution exits the reaction chamber upon completion of the reaction chamber residence time.

In another embodiment the continuous process further comprises the steps of:

(h) separating the silver powder particles from the final aqueous solution;

(i) washing the silver powder particles with deionized water or alcohol; and (j) drying the silver powder particles.

This invention also provides a flow reactor for carrying out the continuous process. The flow reactor has an axis along the length of the reactor, the axis is vertical, and the flow direction is along the axis, the reactor sequentially comprising:

(a) a cylindrical shell-shaped first zone of length l and inner diameter d and having an upper end and a lower end, wherein d is in the range of 0.25 to 6 inches (0.6 to 15 cm), the first zone positioned at the upper end of the reactor and comprising a mixing tee that provides a first inlet of diameter d at the upper end of the first zone to enable injection of a first reactant solution into the first zone along the axis of the reactor and a second inlet of inner diameter a positioned at an angle of 30° to 90° to the axis to enable injection of a second reactant solution into the first zone at the angle to the axis, wherein the first zone has means to control temperature and wherein the ratio a/d is in the range of 0.1 to 1;

(b) a second zone in the form of a truncated circular conical shell and having an upper end and a lower end, wherein the second zone serves as a transition zone and has an inner diameter d at its upper end that is connected to the lower end of the first zone and an inner diameter D at its lower end;

(c) a cylindrical shell-shaped third zone of length L, inner diameter D and having an upper end and a lower end and means to control temperature, wherein the upper end of the third zone is connected to the lower end of the second zone and wherein the ratio D/d is in the range of 1.2 to 6, the ratio l/L is in the range of 0.05 to 0.5 and L is in the range of 2 to 30 feet (0.6 to 9 m); and (d) a fourth zone in the form of a truncated circular conical shell and having an upper end and a lower end with an inner diameter D at its upper end and an inner diameter less than D at its lower end and a valve to control flow rate and keep the reactor pressurized, wherein the upper end of said fourth zone is connected to the lower end of the third zone.

In still another embodiment, the continuous process for preparing a silver powder comprises the steps of:

(a) preparing an acidic aqueous silver salt solution comprising a water soluble silver salt dissolved in deionized water;

(b) preparing an acidic reducing solution comprising:

i. a reducing agent selected from the group consisting of an ascorbic acid, an ascorbate and mixtures thereof dissolved in deionized water;

ii. nitric acid; and iii. one or more particle modifiers;

(c) maintaining the acidic aqueous silver salt solution and the acidic reducing solution at the same temperature $T_M$, wherein $T_M$ is in the range of 10° C. to 90° C.;

(d) providing a flow reactor, wherein the reactor has an axis along the length of the reactor and the axis is vertical, said reactor sequentially comprising:

i. a cylindrical shell-shaped first zone of length l and inner diameter d and having an upper end and a lower end, wherein d is in the range of 0.25 to 6 inches (0.6 to 15 cm), the first zone positioned at the upper end of the reactor and comprising a mixing tee that provides a first inlet of diameter d at the upper end of the first zone to enable injection of a first reactant solution into the first zone along the axis of the reactor and a second inlet of inner diameter a positioned at an angle of 30° to 90° to the axis to enable injection of a second reactant solution into the first zone at the angle to the axis, wherein the first zone has means to control temperature and wherein the ratio a/d is in the range of 0.1 to 1;

ii. a second zone in the form of a truncated circular conical shell and having an upper end and a lower end, wherein the second zone serves as a transition zone and has an inner diameter d at its upper end that is connected to the lower end of the first zone and an inner diameter D at its lower end;

iii. a cylindrical shell-shaped third zone of length L, inner diameter D and having an upper end and a lower end and means to control temperature, wherein the upper end of the third zone is connected to the lower end of the second zone and wherein the ratio D/d is in the range of 1.2 to 6, the ratio l/L is in the range of 0.05 to 0.5 and L is in the range of 2 to 30 feet (0.6 to 9 m); and iv. a fourth zone in the form of a truncated circular conical shell and having an upper end and a lower end with an inner diameter D at its upper end and an inner diameter less than D at its lower end and a valve to control flow rate and keep the reactor pressurized, wherein said upper end of said fourth zone is connected to said lower end of said third zone;

(e) continuously feeding the acidic aqueous silver salt solution into one inlet of the first zone of the flow reactor and continuously feeding the acidic reducing solution into the other inlet of the first zone of the flow reactor to form a reaction mixture in the first zone and maintaining the reaction mixture in the first zone at the temperature $T_M$ of (c), wherein the reaction mixture flows through the first zone into the second zone of the flow reactor, wherein the residence time of the reaction mixture in the first zone and the second zone is up to and including 5 minutes and wherein upon completion of the residence time the reaction mixture exits the second zone and enters the third zone of the flow reactor;

(f) maintaining the reaction mixture in the third zone at the temperature $T_R$ as the reaction mixture flows through the third zone, wherein $T_R$ is in the range of 10° C. to 90° C. and wherein the residence time of the reaction mixture in the third zone of the flow reactor is from 1 to 20 minutes and results in the production of the silver powder particles in a final aqueous solution that enters the fourth zone of the flow reactor upon completion of the third zone residence time; and (g) collecting the silver powder particles in the final aqueous solution as the final aqueous solution exits the fourth zone of the flow reactor.

In another embodiment of the above continuous process, the process further comprises the steps of:

(h) separating the silver powder particles from the final aqueous solution;

(i) washing the silver powder particles with deionized water or alcohol; and (j) drying the silver powder particles.

DETAILED DESCRIPTION OF THE INVENTION

This invention provides a continuous process to efficiently produce a silver powder and for a reactor in which to carry out the process. Use of the reactor to carry out the process results in a powder comprised of silver particles that have a specific morphology that is determined by the process conditions and the use of one or more particle modifiers in the process. These silver particles are highly uniform and highly dispersible.

Figure 1:
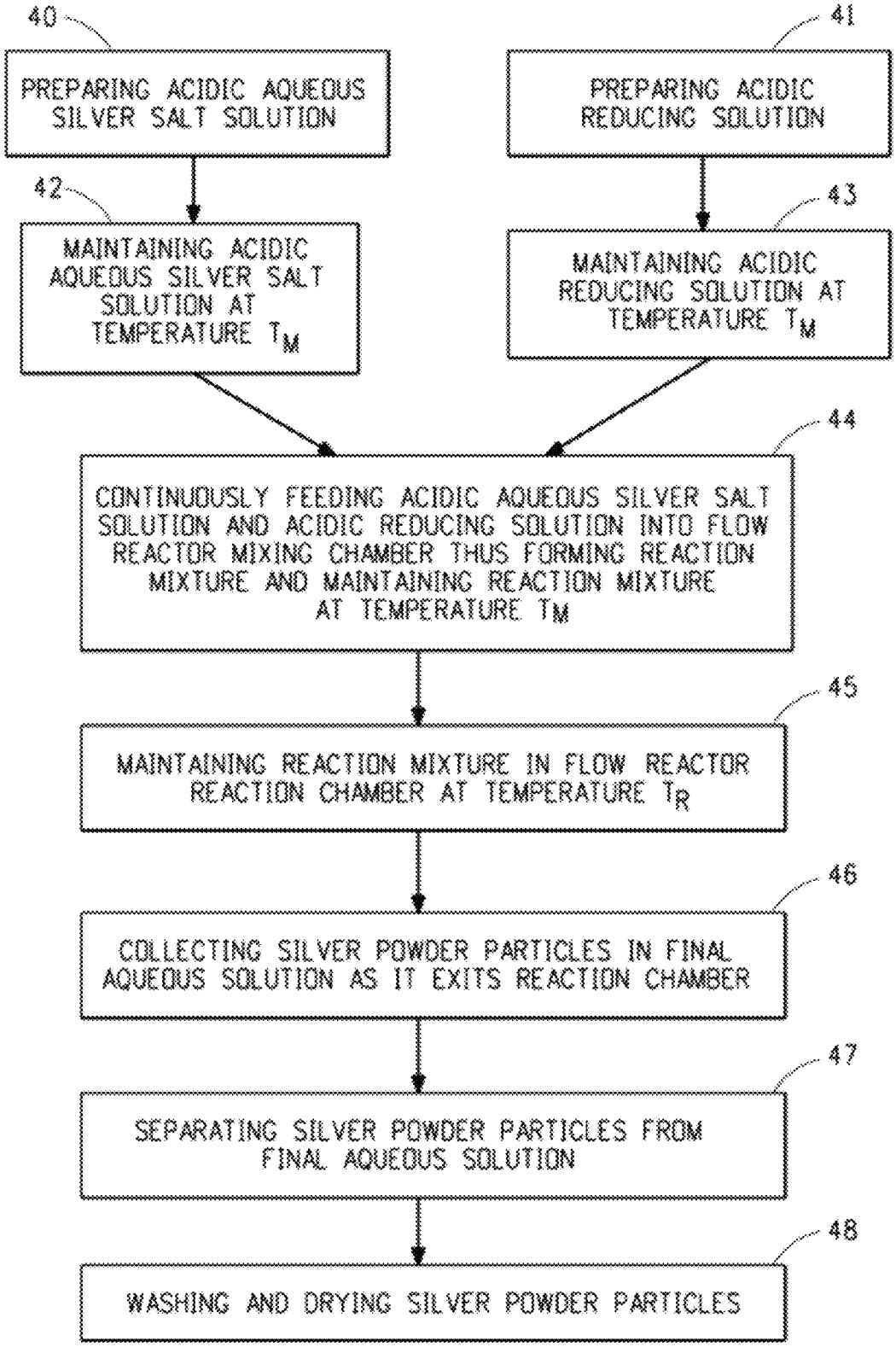
FIG. 1 is a flow chart showing steps in an embodiment of the continuous process for preparing a silver powder.

The continuous process for forming the powders is shown in the flow diagram of FIG. 1. This continuous process is a reductive process in which silver particles with controlled structures are precipitated by adding together an acidic aqueous solution of a water soluble silver salt and an acidic aqueous reducing solution containing a reducing agent, nitric acid and one or more particle modifiers.

The acidic aqueous silver salt solution is prepared 40 by adding a water soluble silver salt to deionized water. Any water soluble silver salt, e.g., silver nitrate, silver phosphate, and silver sulfate, can be used. Silver nitrate is preferred. No complexing agents are used which could provide side reactions that affect the reduction and type of particles produced. Nitric acid can be added to increase the acidity.

The process can be run at concentrations up to and including 1.4 moles of silver per liter of final aqueous silver salt solution. It is preferred to run the process at concentrations less than or equal to 0.47 moles of silver per liter of final aqueous silver salt solution. These relatively high concentrations of silver make the manufacturing process cost effective.

The acidic reducing solution is also an aqueous solution and is prepared 41 by first dissolving the reducing agent in deionized water. Suitable reducing agents for the process are ascorbic acids such as L-ascorbic acid and D-ascorbic acid and related ascorbates such as sodium ascorbate. An ascorbic acid is preferred. Nitric acid and the particle modifiers are then added to the mixture. The particle modifiers serve to control the structure and/or the size of the silver particles. The particle modifiers are surface morphology modifiers that control the morphology of the silver particles or particle size modifiers or both. The particle modifiers are chosen to produce a particular morphology and particle size and are discussed in detail in connection with the various morphologies produced by the process. In some embodiments particle modifiers are added to the acidic aqueous silver salt solution.

The process is typically run such that the pH of the solution after the reduction is completed, i.e., the pH of the final aqueous solution, is less than or equal to 6, most preferably less than 2. This pH is adjusted by adding sufficient nitric acid to the reducing solution and, optionally, to the acidic aqueous silver solution prior to the mixture of these two solutions and the formation of the silver particles. The pH of the acidic reducing solution is in the range of 1 to 5, preferably 2 to 4. This pH of the acidic reducing solution can be adjusted by adding sodium hydroxide.

In addition, a dispersing agent selected from the group consisting of ammonium stearate, stearate salts, polyethylene glycol with molecular weight ranging from 200 to 8000, and mixtures thereof can be added to the acidic reducing solution.

The order of preparing the acidic aqueous silver salt solution and the acidic reducing solution is not important. The acidic aqueous silver salt solution can be prepared before, after, or contemporaneously with the acidic solution. The acidic aqueous silver salt solution and the acidic reducing solution are both maintained 42, 43 at the same temperature $T_M$, wherein $T_M$ is in the range of 10° C. to 90° C.

There is provided a flow reactor comprising (1) a mixing chamber containing two inlets and having a diameter d and (2) a reaction chamber having a diameter D and means to control temperature, wherein D>d. The reactor is in a vertical position and the flow direction is along the axis, i.e., the flow through the reactor is vertical. This eliminates any settling and promotes laminar flow in the reaction chamber. Preferably the mixing chamber is at the top of the reactor and the flow is downward.

The acidic aqueous silver salt solution is continuously fed into one of the inlets of the mixing chamber and the acidic reducing solution is continuously fed into the other inlet of the mixing chamber 44. There is turbulent flow in the mixing chamber as the two solutions rapidly mix and form a reaction mixture. The reaction mixture is maintained at temperature $T_M$. Reaction begins to occur and silver particle nuclei are formed. It is important to have a short residence time in the mixing chamber, i.e., up to and including 5 minutes and preferably up to and including 20 seconds.

The reaction mixture exits the mixing chamber and enters the larger diameter reaction chamber 45 where it is maintained at temperature $T_R$, wherein $T_R$ is in the range of 10° C. to 90° C. $T_M$ and $T_R$ can be the same temperature or different temperatures. The flow in the reaction chamber is slower than in the mixing chamber. This promotes the growth of silver particles with the desired morphology and size and reduces agglomeration caused by turbulence. The residence time in the reaction chamber is sufficient to complete the particle formation without any agglomeration and is from 1 to 20 minutes, preferably from 1 to 5 minutes. The result is a final aqueous solution containing the silver particles.

The final aqueous solution containing the silver particles exits the reaction chamber and is collected 46. The silver particles are then separated 47 from the final aqueous solution by filtration or other suitable liquid-solid separation operations. The silver particles are washed with deionized water or alcohol and then dried 48.

With this process a silver powder comprising silver particles can be made in very large quantities and at low cost in a continuous manner.

Figure 2:
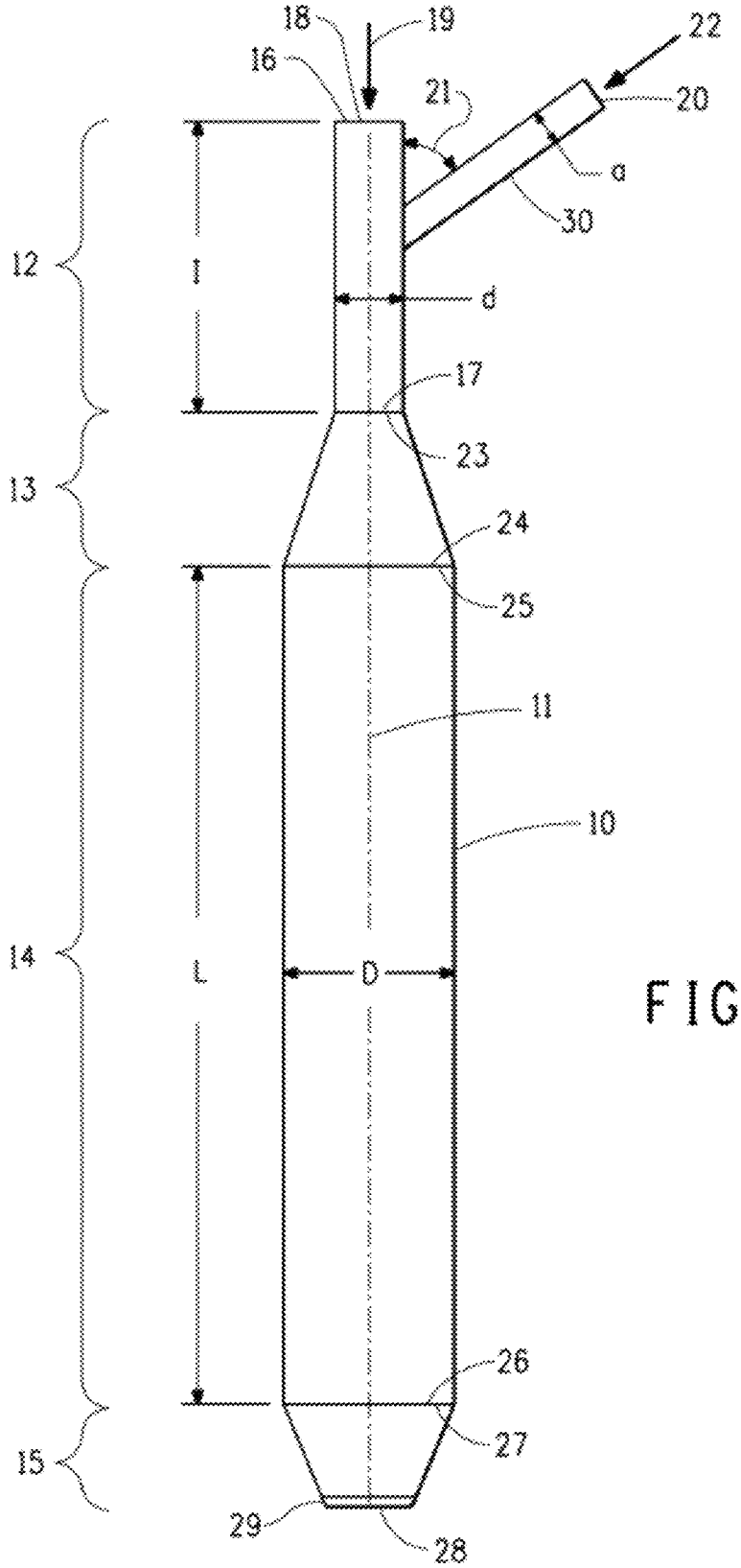
FIG. 2 is a diagram of one embodiment of a reactor used in carrying out the continuous process for preparing a silver powder.

Also provided is an embodiment of a flow reactor for carrying out the continuous process. A diagram of this embodiment is shown in FIG. 2. The flow reactor 10 has an axis 11 along the length of the reactor and the axis is vertical. The flow direction is along the axis 11, i.e., vertical, and preferably downward. In a position for downward flow as shown in FIG. 2, the flow reactor 10, sequentially comprising four zones, has the first zone 12, a mixing chamber, at the top of the reactor. Next is the second zone 13, a transition zone, followed by a third zone 14 which serves as the reaction chamber. A fourth zone 15 at the bottom of the reactor serves as an exit and collection zone The first zone 12 is a cylindrical shell of length l and inner diameter d, wherein d is in the range of 0.25 to 6 inches (0.6 to 15 cm). The first zone 12 has an upper end 16 and a lower end 17. The first zone 12 serves as a mixing chamber. The first zone 12 has a mixing tee comprising a first inlet 18 of diameter d at the upper end 16 of the first zone to enable injection of a first reactant solution 19 into the first zone along the axis 11 of the reactor 10 and the other arm 30 of the mixing tee that provides the second inlet 20 of inner diameter "a" positioned at an angle 21 of 30° to 90° with respect to the axis. The second inlet 20 enables injection of a second reactant solution 22 into the first zone at the angle 21 to the reactor axis 11. The ratio a/d is in the range of 0.1 to 1. The first zone has means to control the temperature of the solutions in that zone.

The second zone 13 is a truncated circular conical shell. The second zone 13 has an upper end 23 and a lower end 24. The second zone 13 has an inner diameter d at its upper end 23 that is connected to the lower end 17 of first zone 12 and an inner diameter D at its lower end 24. The second zone 13 serves as a transition zone between the first zone 12, the mixing chamber with its turbulent flow, and the third zone 14, the reaction chamber with its more laminar flow.

The third zone 14 is a cylindrical shell of length L and inner diameter D. The third zone 14 has an upper end 25 and a lower end 26. The third zone 14 serves as a reaction chamber. The upper end 25 of the third zone 14 is connected to the lower end 24 of the second zone 13. The ratio D/d is in the range of 1.2 to 6, the ratio l/L is in the range of 0.05 to 0.5 and L is in the range of 2 to 30 feet (0.9 to 9 m). The third zone has means to control the temperature of the reaction mixture in that zone.

The fourth zone 15 is in the form of a truncated circular conical shell. The fourth zone 15 has an upper end 27 and a lower end 28. The fourth zone 15 has an inner diameter D at its upper end 27 and an inner diameter less than D at its lower end 28. The upper end 27 of the fourth zone 14 is connected to the lower end 26 of the third zone 13. The fourth zone has a valve 29 at its lower end 27 to control flow rate and keep the reactor pressurized.

In another embodiment d is in the range of 1 to 3 inches (2.5 to 7.6 cm), the ratio a/d is in the range of 0.2 to 0.6, the ratio D/d is in the range of 1.3 to 3, the ratio l/L is in the range of 0.2 to 0.4 and L is in the range of 4 to 10 feet (1.2 to 3 m). In still another embodiment, d is 1.5 inches (3.8 cm), the ratio a/d is 0.5, the ratio D/d is 1.33, the ratio l/L is 0.33, L is 6 feet (1.8 m) and the angle 21 with respect to the axis 11 is 45°.

Any convenient means can be used to control the temperature in the mixing and reaction chambers of the reactor. The simplest means is an electrical heater in the form of a jacket surrounding the chamber. Alternatively, a series of coils surrounding the chamber with a temperature adjusting medium passing through them can be used. A steam jacket and a hot water jacket with or without a heat exchanger are examples of such means. Direct steam injection using ionized water is still another means.

In the embodiment of the process in which the above described reactor is used, it is important to have a short residence time of the reaction mixture in the first and second zones of the flow reactor, i.e., up to and including 5 minutes and preferably up to and including 20 seconds. The residence time of the reaction mixture in the third zone of the flow reactor is from 1 to 20 minutes, preferably from 1 to 5 minutes.

A powder produced using the continuous process is comprised of silver particles that have a specific morphology that is determined by the process conditions and the use of one or more particle modifiers in the process. In one group of embodiments of the continuous process, the resulting particles are spherical and have a closed structure and a smooth surface, i.e., the silver components forming a particle are fused such that only the parts of the silver components forming the surface of the particle can be observed. In another group of embodiments of the continuous process, the resulting particles are spherical and have an open structure, i.e., the silver components forming a particle are assembled to form a particle with open spaces separating the silver components forming the particle. The silver components are only partially attached to each other thereby forming a network with overall spherical shape. The three dimensions of the silver components are clearly discernable.

In both the closed-structured and open-structured embodiments, the particles are described herein as spherically-shaped with the understanding that the particles are generally spherical in shape but are not perfect spheres.

In still other embodiments of the continuous process, the resulting particles are aggregated particles with irregular in shape.

Closed-Structured Spherical Particles

In the one group of embodiments, the continuous process provides spherical silver particles with closed structure and a smooth surface. The acidic aqueous silver salt solution and the acidic reducing solution are prepared as described above and both are maintained at temperature $T_M$. When the two solutions are mixed to form the reaction mixture in the mixing chamber, the two solutions and the reaction mixture formed are maintained at that same temperature $T_M$. In the reaction chamber the reaction mixture is maintained at temperature $T_R$. For these embodiments, the temperatures $T_M$ and $T_R$ are each in the range of 10° C. to 90° C.

Surface morphology modifiers are added to control the morphology of the individual particles and to produce finely divided particles. One particle modifier common to the process embodiments producing powders with spherical particles having a closed structure is a surface morphology modifier selected from the group consisting of potassium sulfate, sodium sulfate, potassium phosphate, sodium phosphate, potassium carbonate, sodium carbonate and mixtures thereof. Potassium sulfate and sodium sulfate are the preferred modifiers for controlling morphology. The amount of this modifier needed for the spherical morphology ranges from $10^{-5}$ moles per gram of silver to $10^{-2}$ moles per gram of silver and the preferred range is from $6\times10^{-5}$ moles per gram of silver to $9\times10^{-3}$ moles per gram of silver. Silver particles that are polyhedrons with faceted morphology are formed when there is insufficient amount of the surface modifier for controlling the morphology of the particles. Silver particles that are highly aggregated and sintered together are formed when too much of the surface modifier for controlling the morphology of the particles is used.

A second particle modifier common to the process embodiments producing powders with spherical particles having a closed structure is a surface morphology modifier selected from the group consisting of gum arabic, gelatin, stearic acid, oleic acid, ammonium stearate and other stearate salts, benzotriazole, salts of polynaphthalene sulfonate formaldehyde condensate such as Daxad™ 19 (manufactured by Hampshire, division of Dow Chemical Co.), poloxamer block copolymers such as Pluronic™ (manufactured by BASF Corp.), phosphate esters such as Gafac™ (manufactured by Rhone Poulenc Surfactants and Specialties), polyethylene glycol with molecular weight ranges from 200 to 8000, and mixtures of these surfactants. Gum arabic and gelatin are preferred modifiers. In some embodiments these modifiers are incorporated in the acidic aqueous silver nitrate solution instead of, or in addition to, in the acidic reducing solution. The amount of this surface modifier ranges from 0.001 g per gram of silver to greater than 0.2 grams per gram of silver. The preferred range to make finely divided particles is from 0.04 to 0.20 grams per gram of silver. Highly agglomerated silver particles are formed when too little surface modifier for controlling the dispersion is used.

In some of these embodiments particle size modifiers are used.

The particle size $d_{50}$ for the closed-structured particles is from 0.3 to 5 μm. The SEM size of the particles can also be determined directly from scanning electron microscope (SEM) images. The ratio of $d_{50}$ to SEM size is in the range of 1-2.

In one such process embodiment to produce silver particles of roughly spherical shape with closed structure, both surface morphology modifiers and particle size modifiers are used. The two surface morphology modifiers used are the ones described above.

Suitable particle size modifiers for this embodiment are metal colloids such as gold colloid or silver colloid. Additional suitable particle size modifiers can be produced in situ by adding a small amount of another reducing agent such as sodium borohydride. Very large particles are formed when there is no colloid added to the process. As additional colloid is added to the process, the particles become smaller. Once the colloid is added to the acidic reducing solution, the acidic reducing solution needs to be used within 5 hours to avoid a change in the targeted particle size.

A preferred combination of particle modifiers for this embodiment is first surface morphology modifier potassium sulfate, second surface morphology modifier gum arabic and particle size modifier gold colloid.

Figure 3:
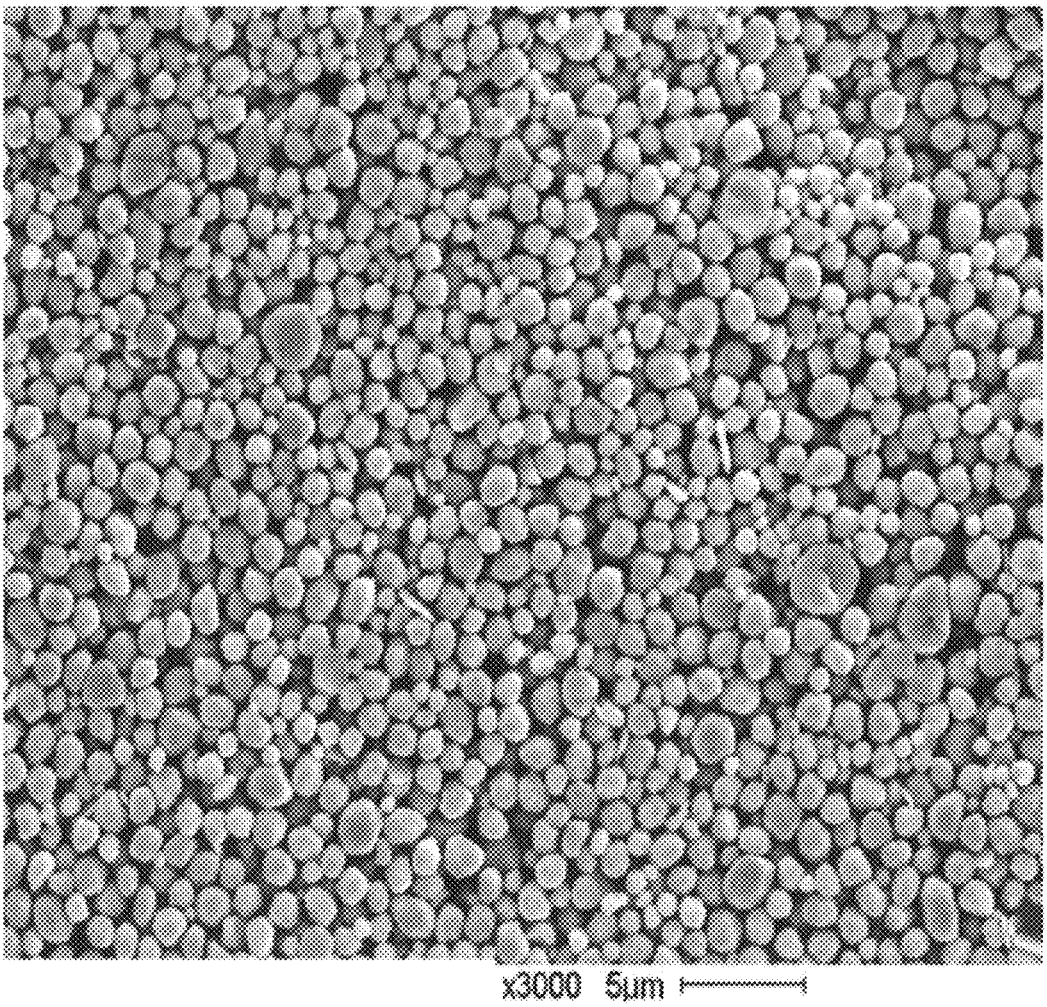
FIG. 3 is a scanning electron microscope image at a magnification of 3,000 of the silver powder made in Example 1 and comprising silver particles of roughly spherical shape and with smooth surfaces.

The structure of the resulting particles is shown in the scanning electron microscope (SEM) image of FIG. 3. It can be seen from the SEM images that the particles have smooth surfaces and are generally spherical in shape but are not perfect spheres.

A variation of this embodiment to produce silver particles of roughly spherical shape with closed structure and with smooth surfaces comprises an acidic aqueous silver salt solution further comprising particle modifier gelatin and an alcohol selected from the group consisting of ethanol, methanol, propanol, isopropyl alcohol and mixtures thereof. The other particle modifier is a surface morphology modifier described above and present in the acidic reducing solution. This surface morphology modifier is selected from the group consisting of potassium sulfate, sodium sulfate, potassium phosphate, sodium phosphate, potassium carbonate, sodium carbonate and mixtures thereof. Potassium sulfate and sodium sulfate are preferred. The resulting particles are similar to those shown in FIG. 3.

Open-Structured Spherical Particles

In another group of embodiments, the continuous process provides spherical silver particles with open structure with the silver components assembled to form the particles being clearly evident in SEM images. The acidic aqueous silver salt solution and the acidic reducing solution are prepared as described above and both are maintained at temperature $T_M$. When the two solutions are mixed to form the reaction mixture in the mixing chamber, the two solutions and the reaction mixture formed are maintained at that same temperature $T_M$. In the reaction chamber the reaction mixture is maintained at temperature $T_R$. For these embodiments, the temperatures $T_M$ and $T_R$ each fall within the range of 10° C. to 90° C.

Surface morphology modifiers are added to control the morphology of the individual particles. One particle modifier common to the process embodiments producing powders with spherical particles having an open structure is selected from the group consisting of sodium citrate, citrate salts, citric acid and mixtures thereof. Sodium citrate is preferred. The amount of the surface modifier used ranges from 0.001 gram of surface modifier per gram of silver to greater than 0.5 gram of surface modifier per gram of silver. The preferred range is from about 0.02 to about 0.3 gram of surface modifier per gram of silver.

The particle size $d_{50}$ for the closed-structure particles is from 0.3 to 5 μm. The SEM size of the particles can also be determined directly from scanning electron microscope (SEM) images. The ratio of $d_{50}$ to SEM size is in the range of 1-2.

In one type of embodiment for producing open-structured particles, the particle modifier is the surface morphology modifier selected from the group consisting of sodium citrate, citric acid and mixtures thereof as mentioned above. For this type of embodiment, the temperatures $T_M$ and $T_R$ are each in the range of 10° C. to 90° C.

Figure 4:
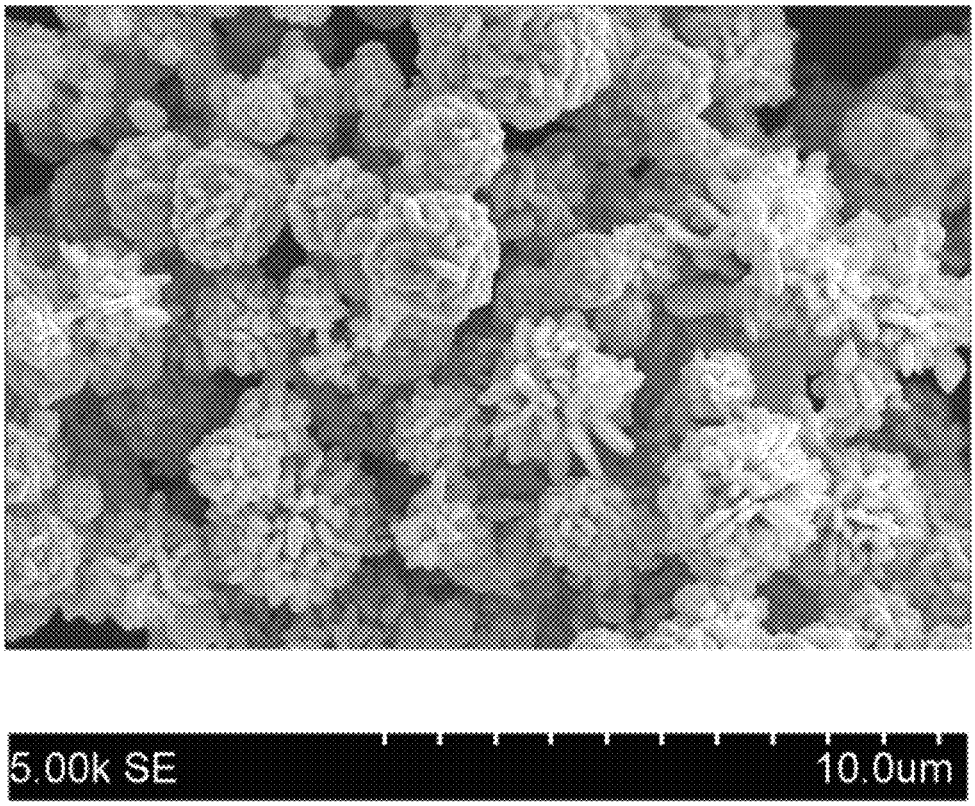
FIG. 4 is a scanning electron microscope image at a magnification of 5,000 of the silver powder made in Example 3 and comprising spherically-shaped, open-structured silver particles
Figure 5:
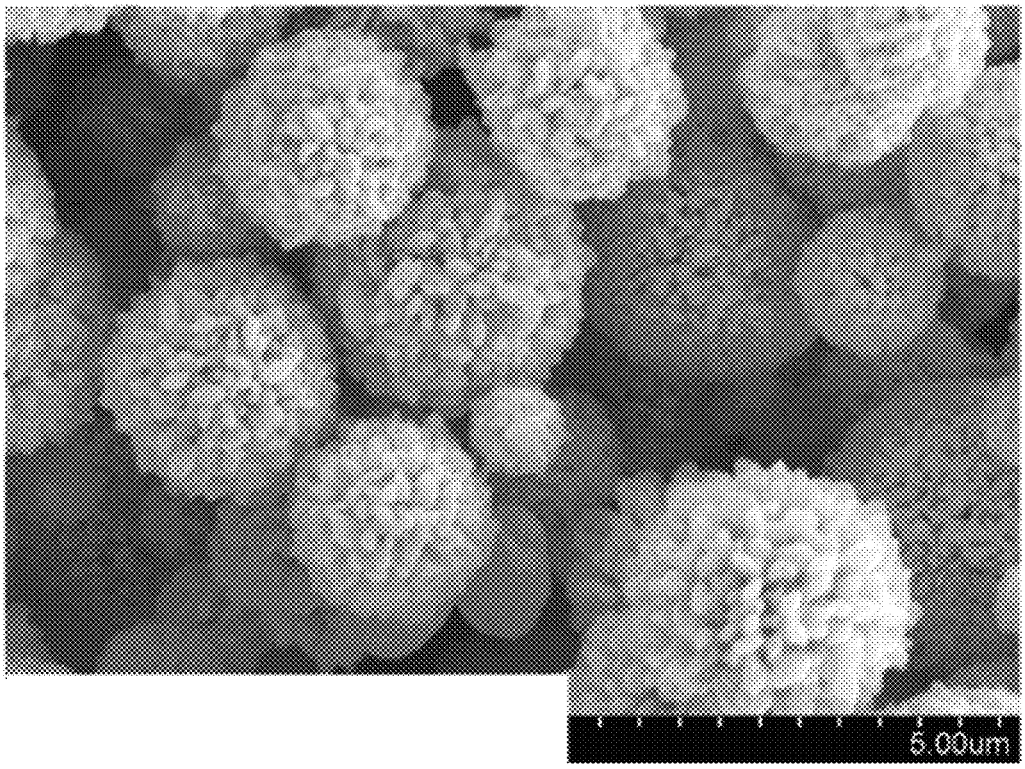
FIG. 5 is a scanning electron microscope image at a magnification of 10,000 of the silver powder made in Example 4 and comprising spherically-shaped, open-structured silver particles wherein the surface of the particles resemble the surface of the rind of an orange

The structure of the resulting particles is shown in the scanning electron microscope images of FIGS. 4 and 5. It can be seen from the SEM images that the particles are generally spherical in shape but are not perfect spheres. The silver components making up the particles are evident as is the irregular surface and open structure that they form.

In a further type of embodiment for producing open-structured particles, two particle modifiers are used. One is the surface morphology modifier selected from the group consisting of sodium citrate, citric acid and a mixture thereof as mentioned above. The second is a surface modifier is selected from the group consisting of water soluble copper compounds that are sources of $Cu^{2+}$ ions when dissolved in water. Examples of such compounds include copper (II) nitrate, copper (II) acetate, copper (II) sulfate and mixtures thereof. Copper nitrate is preferred. The amount of the second surface modifier used ranges from 0.00001 gram of second surface modifier per gram of silver to 0.0050 gram of second surface modifier per gram of silver. The preferred range is from about 0.0006 to about 0.0024 gram of second surface modifier per gram of silver.

The acidic aqueous silver salt solution and the acidic reducing solution are prepared as described above and both are maintained at temperature $T_M$. When the two solutions are mixed to form the reaction mixture in the mixing chamber, the two solutions and the reaction mixture formed are maintained at that same temperature $T_M$. In the reaction chamber the reaction mixture is maintained at temperature $T_R$. For these embodiments, the temperatures $T_M$ and $T_R$ are each in the range of 10° C. to 65° C.

Figure 6:
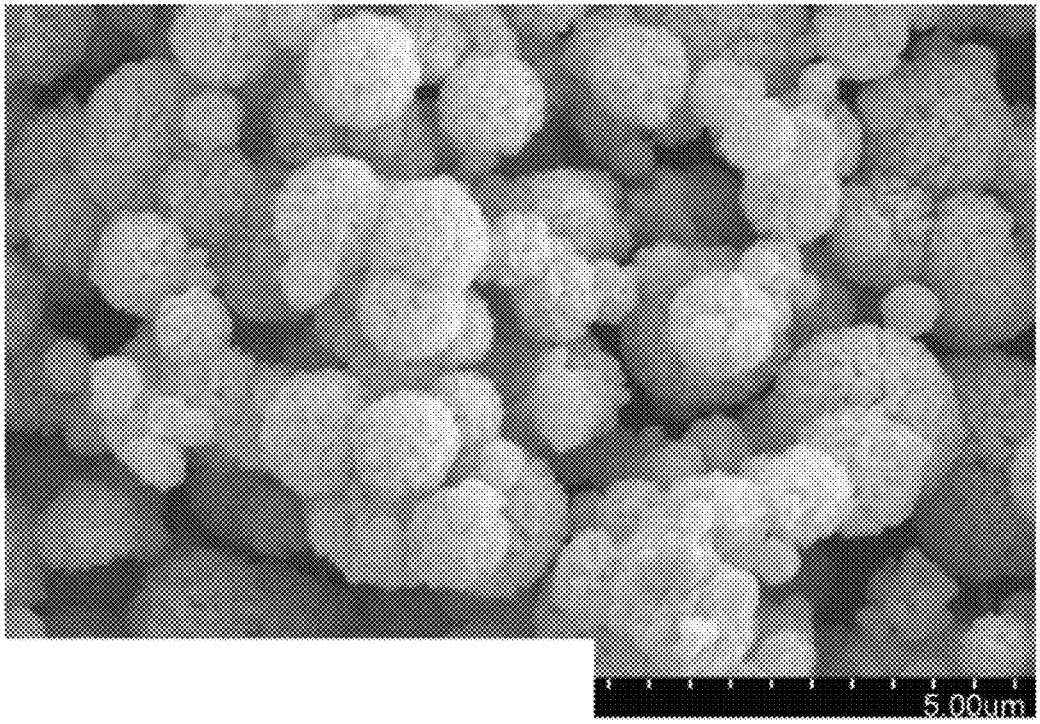
FIG. 6 is a scanning electron microscope image at a magnification of 10,000 of the silver powder made in Example 5 and comprising spherically-shaped open-structured silver particles.

The structure of the resulting particles is shown in the scanning electron microscope image of FIG. 6. It can be seen from the SEM image that the particles are generally spherical in shape but are not perfect spheres. The silver components making up a particle surface are evident as is the irregular and open structure that they form.

The silver particles produced by the various embodiments of this process can be used in thick film paste applications, including thick films for front side metallization of photovoltaic solar cells.

EXAMPLES

The following examples and discussion are offered to further illustrate, but not limit the process of this invention. Note that particle size distribution numbers ($d_{10}$, $d_{50}$, $d_{90}$) were measured using a Microtrac® Particle Size Analyzer from Leeds and Northrup. The $d_{10}$, $d_{50}$ and $d_{90}$ represent the 10th percentile, the median or 50th percentile and the 90th percentile of the particle size distribution, respectively, as measured by volume. That is, the $d_{50}$ ($d_{10}$, $d_{90}$) is a value on the distribution such that 50% (10%, 90%) of the particles have a volume of this value or less.

Example 1

This Example produced silver particles with roughly spherical shapes and smooth surfaces.

The acidic aqueous silver salt solution was prepared by dissolving silver nitrate in deionized water. The concentration of silver nitrate was 23 wt % based on the total weight of the acidic aqueous silver salt solution The acidic aqueous silver salt solution was kept at room temperature, about 22° C., while continuously stirring.

The acidic reducing solution was prepared by adding and dissolving gum arabic to deionized water and aging for 15-60 minutes while stirring at room temperature, about 22° C. Ascorbic acid is then added to this solution. This solution was continuously stirred and the temperature maintained at room temperature. Nitric acid (70%) was then added to the solution followed by the addition of potassium sulfate. As a final step, a gold colloid solution was added. The acidic reducing solution concentrations in weight %, based on the total weight of the acidic reducing solution, were 2.96% nitric acid solution (70%), 0.44% potassium sulfate, 1.48% gum arabic, 0.15% gold colloid and 5.93% ascorbic acid.

These two solutions were fed into the flow reactor 10 with the geometry shown in FIG. 2 and the dimensions l=2 feet (0.6 m), L=6 feet (1.8 m), d=1.5 inches (3.8 cm), D=2 inches (5.1 cm), a=¾ inch (1.9 cm), and the angle 21 is 45°. The acidic reducing solution was fed into the first inlet 18 at the top 16 of the first zone 12 of the flow reactor 10 at a mass rate 0.86 KPM (kilogram per minute). The acidic aqueous silver salt solution was fed into the second inlet 20 at an angle of 45° with respect to the axis 11 at a mass rate 0.28 KPM. The reaction mixture formed was maintained at room temperature, about 22° C., in the first zone. The reaction mixture in the reaction chamber, the third zone 14, was also maintained at room temperature, about 22° C.

The final aqueous solution was collected as it exited the lower end 27 of the flow reactor. The final aqueous solution was filtered and the silver powder collected. The silver powder was washed with deionized water until a conductivity of the wash water was less than or equal to 100 microsiemans. The silver powder was dried for 30 hours at 30° C.

The silver powder was comprised of silver particles, wherein the particles had roughly spherical shapes and smooth surfaces as shown in the scanning electron microscope (SEM) image of FIG. 3 (3,000 magnification). $d_{10}$, $d_{50}$, and $d_{90}$ were 0.81 μm, 1.20 μm and 1.88 μm, respectively.

Example 2

This Example produced silver particles with roughly spherical shapes and smooth surfaces.

The acidic aqueous silver salt solution was prepared as follows. Silver nitrate was dissolved in deionized water. The concentration of silver nitrate was 20 wt % based on the total weight of the silver nitrate and the deionized water. This solution was maintained at room temperature, about 22° C., while continuously stirring. Gelatin and ethanol were slowly added and this solution was aged for 15 to 60 minutes to obtain the acidic aqueous silver salt solution. The acidic aqueous silver salt solution concentrations in weight %, based on the total weight of the acidic aqueous silver salt solution, were 7.3% silver nitrate, 0.5% gelatin, 0.5% ethanol and 91.7% deionized water. The acidic aqueous silver salt solution was maintained at room temperature.

The acidic reducing solution was prepared by dissolving ascorbic acid in deionized water along with sodium sulfate and nitric acid. The solution was aged for 15-60 minutes while stirring at room temperature, about 22° C. The acidic reducing solution concentrations in weight %, based on the total weight of the acid reducing solution, were 3.8% ascorbic acid, 3.7% nitric acid, 0.1% sodium sulfate and 92.4% deionized water.

These two solutions were fed into the flow reactor with the geometry shown in FIG. 2 and dimensions described in Example 1. The acidic reducing solution was fed into the first inlet 18 at the top 16 of the first zone 12 of the flow reactor 10 at a mass rate 0.58 KPM (kilogram per minute). The acidic aqueous silver salt solution was fed into the second inlet 20 at an angle of 45° with respect to the axis 11 at a mass rate 0.58 KPM. The reaction mixture formed was maintained at room temperature, about 22° C., in the first zone. The reaction mixture in the reaction chamber, the third zone 14, was also maintained at room temperature, about 22° C.

The final aqueous solution was collected as it exited the lower end 27 of the flow reactor. The final aqueous solution was filtered and the silver powder collected. The silver powder was washed with deionized water until a conductivity of the wash water was less than or equal to 100 microsiemans. The silver powder was dried for 30 hours at 30° C.

The silver powder was comprised of silver particles, wherein the particles had roughly spherical shapes and smooth surfaces similar to those shown in the scanning electron microscope (SEM) image of FIG. 3 (3,000 magnification).

Example 3

This Example produced silver particles comprising silver components assembled to form spherically-shaped, open-structured particles The acidic aqueous silver salt solution was prepared by dissolving silver nitrate in deionized water. The concentration of silver nitrate was 24.2 wt % based on the total weight of the silver nitrate and the deionized water. This solution was maintained at 50° C. while continuously stirring.

The acidic reducing solution was prepared by dissolving ascorbic acid in deionized water along with sodium citrate and nitric acid. The acidic reducing solution concentrations in weight %, based on the total weight of the acid reducing solution, were 5.45% ascorbic acid, 2.42% nitric acid solution (70%), 1.21% sodium citrate and 90.92% deionized water. This solution was maintained at 50° C. while continuously stirring.

These two solutions were fed into the flow reactor with the geometry shown in FIG. 2 and the dimensions l=3 inches (7.6 cm), L=6 feet (0.9 m), d=⅜ inch (0.96 cm), D=0.5 inch (1.3 cm), a=¼ inch (0.64 cm), and the angle 21 is 45°. The acidic reducing solution was fed into the first inlet 18 at the top 16 of the first zone 12 of the flow reactor 10 at a mass rate 167 GPM (grams per minute). The acidic aqueous silver salt solution was fed into the second inlet 20 at an angle of 45° with respect to the axis 11 at a mass rate 66 GPM. The reaction mixture formed was maintained at 50° C., in the first zone. The reaction mixture in the reaction chamber, the third zone 14, was also maintained at 50° C.

The final aqueous solution was collected as it exited the lower end 27 of the flow reactor. The final aqueous solution was filtered and the silver powder collected. The silver powder was washed with deionized water until a conductivity of the wash water was less than or equal to 100 microsiemans. The silver powder was dried for 30 hours at 30° C.

The silver powder was comprised of silver particles, wherein the particles are spherically-shaped and open-structured particles as shown in the scanning electron microscope (SEM) image of FIG. 4 (5,000 magnification). $d_{10}$, $d_{50}$, and $d_{90}$ were 2.5 μm, 5.6 μm and 15.36 μm, respectively.

Example 4

This Example produced silver particles comprising silver components 100-500 nm long, 80-100 nm wide and 80-100 nm thick assembled to form spherically-shaped, open-structured particles, wherein the surfaces of the particles resemble the surface of the rind of an orange.

The acidic aqueous silver salt solution was prepared by dissolving silver nitrate in deionized water. The concentration of silver nitrate was 24.2 wt % based on the total weight of the silver nitrate and the deionized water. This solution was maintained at room temperature, about 22° C., while continuously stirring.

The acidic reducing solution was prepared by dissolving ascorbic acid in deionized water along with sodium citrate and nitric acid. The acidic reducing solution concentrations in weight %, based on the total weight of the acid reducing solution, were 5.45% ascorbic acid, 2.42% nitric acid solution (70%), 1.21% sodium citrate and 90.92% deionized water. This solution was maintained at 50° C. while continuously stirring.

These two solutions were fed into the flow reactor with the geometry shown in FIG. 2 and dimensions described in Example 3. The acidic reducing solution was fed into the first inlet 18 at the top 16 of the first zone 12 of the flow reactor 10 at a mass rate 167 GPM (grams per minute). The acidic aqueous silver salt solution was fed into the second inlet 20 at an angle of 45° with respect to the axis 11 at a mass rate 66 GPM. The reaction mixture formed was maintained at room temperature, about 22° C., in the first zone. The reaction mixture in the reaction chamber, the third zone 14, was also maintained at room temperature, about 22° C.

The final aqueous solution was collected as it exited the lower end 27 of the flow reactor. The final aqueous solution was filtered and the silver powder collected. The silver powder was washed with deionized water until a conductivity of the wash water was less than or equal to 100 microsiemans. The silver powder was dried for 30 hours at 30° C.

The silver powder was comprised of silver particles, wherein the particles are spherically-shaped and open-structured particles and the surfaces of the particles resemble the surface of the rind of an orange as shown in the scanning electron microscope (SEM) image of FIG. 5 (10,000 magnification). $d_{10}$, $d_{50}$, and $d_{90}$ were 2.5 μm, 5.6 μm and 15.36 μm, respectively.

Example 5

This Example produced silver particles comprising spherically-shaped particles with non-spherical silver components 20-200 nm in size assembled to form an open-structure surface, The acidic aqueous silver salt solution was prepared by dissolving silver nitrate in deionized water. The concentration of silver nitrate was 24.2 wt % based on the total weight of the silver nitrate and the deionized water. This solution was also maintained at room temperature, about 22° C., while continuously stirring.

The acidic reducing solution was prepared by dissolving ascorbic acid in deionized water along with sodium citrate, nitric acid and copper nitrate. The acidic reducing solution concentrations in weight %, based on the total weight of the acid reducing solution, were 5.45% ascorbic acid, 2.42% nitric acid solution (70%), 1.21% sodium citrate, 0.01% copper nitrate and 90.91% deionized water. This solution was maintained at room temperature, about 22° C., while continuously stirring.

These two solutions were fed into the flow reactor with the geometry shown in FIG. 2 and dimensions described in Example 3. The acidic reducing solution was fed into the first inlet 18 at the top 16 of the first zone 12 of the flow reactor 10 at a mass rate 167 GPM (grams per minute). The acidic aqueous silver salt solution was fed into the second inlet 20 at an angle of 45° with respect to the axis 11 at a mass rate 66 GPM. The reaction mixture formed was maintained at room temperature, about 22° C., in the first zone. The reaction mixture in the reaction chamber, the third zone 14, was also maintained at room temperature, about 22° C.

The final aqueous solution was collected as it exited the lower end 27 of the flow reactor. The final aqueous solution was filtered and the silver powder collected. The silver powder was washed with deionized water until a conductivity of the wash water was less than or equal to 100 microsiemans. The silver powder was dried for 30 hours at 30° C.

The silver powder was comprised of silver particles, wherein the particles are spherically-shaped and open-structured particles as shown in the scanning electron microscope (SEM) image of FIG. 6 (10,000 magnification). $d_{10}$, $d_{50}$, and $d_{90}$ were 0.8 μm, 1.77 μm and 3.41 μm, respectively.

What is claimed is:

1. A continuous process for preparing a silver powder comprising silver particles, said process comprising the steps of:

(a) preparing an acidic aqueous silver salt solution comprising a water soluble silver salt dissolved in deionized water;

(b) preparing an acidic reducing solution comprising:

(i) a reducing agent selected from the group consisting of an ascorbic acid, an ascorbate and mixtures thereof dissolved in deionized water;

(ii) nitric acid; and (iii) one or more particle modifiers;

(c) maintaining said acidic aqueous silver salt solution and said acidic reducing solution at the same temperature $T_M$, wherein $T_M$ is in the range of 10° C. to 90° C.;

(d) providing a flow reactor, wherein said reactor has an axis along the length of said reactor and said axis is vertical, said reactor sequentially comprising:

(1) a cylindrical shell-shaped first zone of length l and inner diameter d and having an upper end and a lower end, wherein d is in the range of 0.25 to 6 inches (0.6 to 15 cm), said first zone positioned at the top of said reactor and comprising a mixing tee that provides a first inlet of diameter d at the upper end of said first zone to enable injection of a first reactant solution into said first zone along said axis of said reactor and a second inlet of inner diameter a positioned at an angle of 30° to 90° to said axis to enable injection of a second reactant solution into said first zone at said angle to said axis, wherein said first zone has means to control temperature and wherein the ratio o/d is in the range of 0.1 to 1;

(2) a second zone in the form of a truncated circular conical shell and having an upper end and a lower end, wherein said second zone serves as a transition zone and has an inner diameter d at said upper end of said second zone that is connected to said lower end of said first zone and an inner diameter D at said lower end of said second zone;

(3) a cylindrical shell-shaped third zone of length L, inner diameter D and having an upper end and a lower end and means to control temperature, wherein the upper end of said third zone is connected to the lower end of said second zone and wherein the ratio D/d is in the range of 1.2 to 6, the ratio l/L is in the range of 0.05 to 0.5 and L is in the range of 2 to 30 feet (0.9 to 9 m); and (4) a fourth zone in the form of a truncated circular conical shell and having an upper end and a lower end with an inner diameter D at its upper end and an inner diameter less than D at its lower end and a valve to control flow rate and keep said reactor pressurized, wherein said upper end of said fourth zone is connected to said lower end of said third zone;

(e) continuously feeding said acidic aqueous silver salt solution into one inlet of said first zone of said flow reactor and continuously feeding said acidic reducing solution into the other inlet of said first zone of said flow reactor to form a reaction mixture in said first zone and maintaining said reaction mixture in said first zone at the temperature $T_M$ of (c), wherein the reaction mixture flows through said first zone into said second zone of said flow reactor, wherein the residence time of the reaction mixture in said first zone and said second zone is up to and including 5 minutes and wherein upon completion of said residence time said reaction mixture exits said second zone and enters said third zone of said flow reactor;

(f) maintaining said reaction mixture in said third zone of said flow reactor at temperature $T_R$ as said reaction mixture flows through said third zone, wherein $T_R$ is in the range of 10° C. to 90° C. and wherein the residence time of said reaction mixture in said third zone of said flow reactor is from 1 to 20 minutes and results in the production of said silver powder particles in a final aqueous solution that enters said fourth zone of said flow reactor upon completion of said third zone residence time; and (g) collecting said silver powder particles in said final aqueous solution as said final aqueous solution exits said fourth zone of said flow reactor.

2. The continuous process of claim 1, said process further comprising:

(h) separating said silver powder particles from said final aqueous solution;

(i) washing the silver powder particles with deionized water or alcohol; and (j) drying said silver powder particles.

3. The continuous process of claim 1, wherein the residence time of the reaction mixture in said first zone and said second zones is up to and including 20 seconds and wherein said residence time of said reaction mixture in said third zone of said flow reactor is from 1 to 5 minutes.

4. The continuous process of claim 1, wherein said $T_M$ and said $T_R$ are the same temperature.

5. The continuous process of claim 1, wherein said acidic reducing solution is fed continuously into said first inlet at the upper end of said first zone and said acidic aqueous silver salt solution is fed continuously into said second inlet positioned at said angle.

6. The continuous process of claim 1, wherein, in said flow reactor, said inner diameter d is in the range of 1 to 3 inches (2.5 to 7.5 cm), said ratio a/d is in the range of 0.2 to 0.6, said ratio D/d is in the range of 1.3 to 3, said ratio l/L is in the range of 0.2 to 0.4 and said L is in the range of 4 to 10 feet (1.2 to 3 m).

7. The continuous process of claim 6, wherein, in said flow reactor, said inner diameter d is 1.5 inches (3.8 cm), said ratio o/d is 0.5, said ratio D/d is 1.33, said ratio l/L is 0.33, said L is 6 feet (1.8 m) and said angle is 45'.

8. The continuous process of claim 1, said one or more particle modifiers comprising a first surface morphology modifier selected from the group consisting of potassium sulfate, sodium sulfate, potassium phosphate, sodium phosphate, potassium carbonate, sodium carbonate and mixtures thereof and a second surface morphology modifier selected from the group consisting of gum arabic, gelatin, stearic acid, oleic acid, ammonium stearate and other stearate salts, benzotriazole, salts of polynaphthalene sulfonate formaldehyde condensate, poloxamer block copolymers, phosphate esters, polyethylene glycol with molecular weight ranges from 200 to 8000, and mixtures thereof.

9. The continuous process of claim 8, said one or more particle modifiers further comprising a particle size modifier selected from the group consisting of metal colloids.

10. The continuous process of claim 9, wherein said water soluble silver salt is silver nitrate, said reducing agent is ascorbic acid, said first surface morphology modifier is potassium sulfate, said second surface morphology modifier is gum arabic and said particle size modifier is gold colloid.

11. The continuous process of claim 1, said acidic aqueous silver salt solution further comprising gelatin and an alcohol selected from the group consisting of ethanol, methanol, propanol, isopropyl alcohol and mixtures thereof; said one or more particle modifiers comprising a surface morphology modifier selected from the group consisting of potassium sulfate, sodium sulfate, potassium phosphate, sodium phosphate, potassium carbonate, sodium carbonate and mixtures thereof.

12. The continuous process of claim 11, wherein said water soluble silver salt is silver nitrate, said reducing agent is ascorbic acid, said alcohol is ethanol and said surface morphology modifier is sodium sulfate.

13. The continuous process of claim 1, said particle modifier comprising a surface morphology modifier selected from the group consisting of sodium citrate, citric acid and a mixture thereof.

14. The continuous process of claim 13, wherein said water soluble silver salt is silver nitrate, said reducing agent is ascorbic acid and said surface morphology modifier is sodium citrate.

15. The continuous process of claim 1, said particle modifier comprising a first surface morphology modifier selected from the group consisting of sodium citrate, citric acid and a mixture thereof and a second surface morphology modifier selected from the group consisting of water soluble copper compounds that are sources of $Cu^{2+}$ ions when dissolved in water and said temperature $T_M$ and said temperature $T_R$ are each in the range of 10° C. to 65° C.

16. The continuous process of claim 15, wherein said water soluble silver salt is silver nitrate, said reducing agent is ascorbic acid, said first surface morphology modifier is sodium citrate and said second surface morphology modifier is copper nitrate.

* * * * *

UNITED STATES PATENT AND TRADEMARK OFFICE

CERTIFICATE OF CORRECTION

PATENT NO. : 8,574,338 B2
APPLICATION NO. : 12/948098
DATED : November 5, 2013
INVENTOR(S) : Roberto Irizarry et al.

It is certified that error appears in the above-identified patent and that said Letters Patent is hereby corrected as shown below:

In the Claims:

In Column 14, Claim 1, Section (d)(1), Line 34, please change "o/d" to read -- a/d --.

In Column 15, Claim 7, Line 44, please change "o/d" to read -- a/d --.

In Column 15, Claim 7, Line 45, please change "45'" to read -- 45° --.

Signed and Sealed this
Twenty-fourth Day of December, 2013

Margaret A. Focarino

Margaret A. Focarino
*Commissioner for Patents of the United States Patent and Trademark Office*